United States Patent [19]

Simpson

[11] Patent Number: 4,790,550

[45] Date of Patent: Dec. 13, 1988

[54] SCOOTER

[76] Inventor: Paul A. Simpson, 22844 Halburton Rd., Beachwood, Ohio 44122

[21] Appl. No.: 13,906

[22] Filed: Feb. 12, 1987

[51] Int. Cl.[4] ..... A63C 17/14

[52] U.S. Cl. ..... 280/87.04 A; 188/6; 188/29; 188/74

[58] Field of Search ..... 280/87.04 R, 87.04 A, 280/12 H; 188/6, 29, 74

[56] References Cited

U.S. PATENT DOCUMENTS

| | | | |
|---|---|---|---|
| 2,027,620 | 1/1936 | Schaad | 280/87.04 A |
| 2,045,983 | 6/1936 | Ferrigno | 280/87.04 A |
| 2,134,318 | 10/1938 | Ruzich | 280/87.04 R |
| 2,449,336 | 9/1948 | Spitzwieser | 280/87.04 R |
| 3,288,251 | 11/1966 | Sakwa | 280/87.04 A |
| 4,037,852 | 7/1977 | Bayer et al. | 280/87.04 A |
| 4,145,065 | 3/1979 | Kupka | 280/87.04 R |
| 4,165,091 | 8/1979 | Chadwick | 280/12 H |
| 4,168,076 | 9/1979 | Johnson | 280/87.04 A X |
| 4,179,134 | 12/1979 | Atkinson | 280/87.04 A |
| 4,521,029 | 6/1985 | Mayes | 280/12 H X |

*Primary Examiner*—John J. Love
*Assistant Examiner*—Michael Mar
*Attorney, Agent, or Firm*—Baldwin, Egan & Fetzer

[57] ABSTRACT

A child's foot-assisted scooterlike locomotion device is provided which is adapted for use with wheels on improved hard surfaces and for use with skids for use on snow-covered surfaces. Turning of the device is accomplished, irrespective of whether the device is equipped with wheels or skids, by a shift of weight on the device in the direction in which turning is to occur.

8 Claims, 5 Drawing Sheets

10
12
14
16
18
20
22
24
26
28
30
32
40
42
44
46
48
50
80
82
2
3

SCOOTER

THE FIELD OF THE INVENTION

This invention relates to locomotion devices primarily for children. More specifically, this invention relates to a scooterlike device which is adapted for use with wheels on improved hard surfaces and with skids for use on snow-covered surfaces.

BACKGROUND DISCUSSION (a) Prior Art

Skateboards and skateboard hardware are well-known in the prior art. Essentially, a skateboard comprises a board approximately 8"×24" to which pairs of skateboard wheels are attached to the underside of the board, front and back. This device is inherently dangerous and should not be used without proper training, supervision and protective clothing. In particular, skateboards should not be used by young children. Two-wheeled and three-wheeled scooters are also well-known in the art. Neither skateboards nor scooters can function in snow. The present invention is an improvement over both of these prior art devices without having their disadvantages.

(b) General Discussion of the Invention

The subject invention is an all-season toy which utilizes the performance attributes of skateboards while minimizing their propensity for inflicting physical injury on their users. In addition, the subject invention makes available to younger children the pleasures of a safe toy which provides the enjoyment of a skateboard. In its preferred embodiment, the subject invention combines the safety of a conventional two-wheeled or three-wheeled scooter with the performance characteristics of a conventional skateboard. In addition, the subject invention includes unique safety provisions which render the invention superior to either a scooter or a skateboard. Of particular interest with respect to this invention is the fact that the invention can be retrofitted from summer use to winter use by substituting skids for skate wheels. Thus, what is disclosed herein is a toy for all seasons.

The preferred embodiment of the invention comprises an elongated foot board to which is attached a collapsible impact superstructure to the front top side of the board. Novel foot-operated brake means are secured to the rear portion of the board. Conventional skateboard wheels or snow skids are secured to the underside of the board, front and back. The collapsible impact structure, in appearance only, is patterned after the traditional orange crate which was so popular for use in homemade scooters generations ago. Although wood for toys has fallen somewhat into disuse in recent times, wood has excellent physical properties for the purposes of this invention. Thus, wood is sufficiently rigid to provide stability, balance and as a rest for the user's hands for steering purposes. In addition, with a proper selection of threaded fasteners, wood can be adapted to yield upon impact beyond a predetermined force. Accordingly, the simulated wooden orange crate will absorb energy by deformation and thereby minimize the consequences of impact upon the user due to a sudden accidental stop.

The foot brake comprises a U-shaped board which fits about the rear end portion of the foot board. By stepping on the brake board, the rider forces the brake board into frictional contact with a speed-retarding surface. When the device is wheelmounted, the brake board makes frictional engagement with the wheels. When the device is skid-mounted, a brake board attachment mades contact with the supporting surface.

OBJECTS OF THE INVENTION

It is, therefore, among the objects of this invention to provide a foot-assisted locomotion device which: can be safely used by young children; combines the enjoyment of a skateboard with the safety of a scooter; has unique safety provisions to render the device superior to either a scooter or a skateboard; has a unique foot brake means for coaction with skateboard type wheels or snow-covered surfaces; has a foot brake which can be easily actuated by a small child; has a collapsible impact device positioned in front of the rider to absorb the energy of impact in the event of an accidental head-on collision; is easy to steer and is safe to ride; and which can be easily retrofitted with skids for use on snow-covered surfaces.

These and other objects, features and advantages of the invention will become apparent in view of the following detailed description of the preferred embodiments shown and described herein and as illustrated in the accompanying drawings in which.

DETAILED DESCRIPTION OF THE INVENTION

Figures 1, 2:
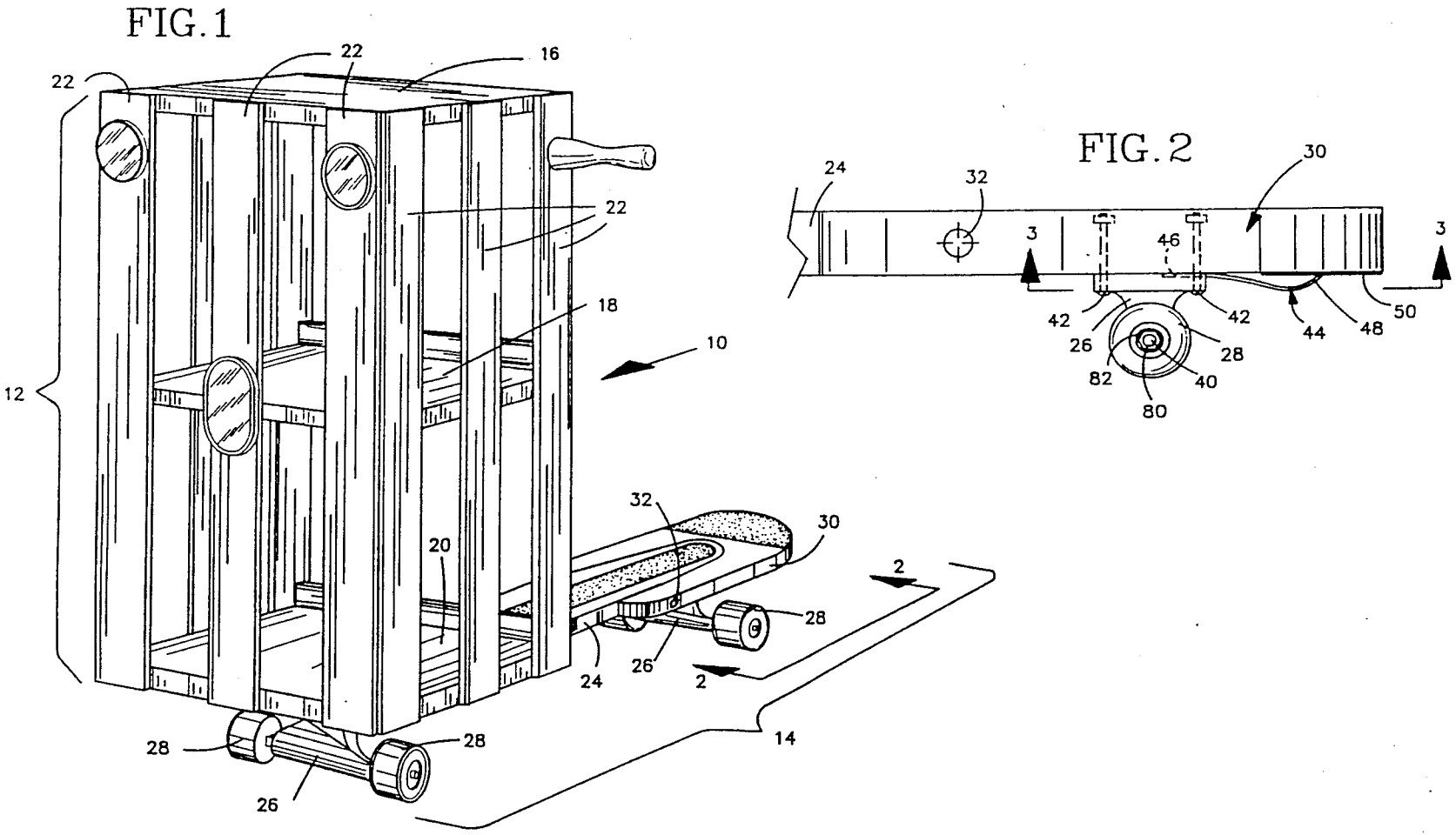
FIG. 1 is a perspective view of a preferred embodiment of the invention equipped with wheels for summer use.
FIG. 2 is a fragmentary side elevational view taken along the line 2—2 of FIG. 1.

Reference is first made to FIG. 1, which illustrates a preferred embodiment of the invention adapted for summer use. The invention 10 is essentially comprised of two major components,—the collapsible impact barrier 12, and the chassis 14. The barrier 12, in turn, is comprised of a top wooden shelf 16, a middle shelf 18 and a bottom shelf 20. The shelves are approximately each 14" square and approximately 1" thick. Slats 22, are secured to each of the side and front edges of the shelves and fastened to each shelf edge with two 1" No. 8 wood screws. No other means are utilized to secure the slats to the shelves, such as glue, braces or other threaded fasteners. Thus, an impact received by either the top shelf 16 or middle shelf 18 will cause a twisting tearing action between the shelves, screws and slats. The barrier will yield to the impact and consume energy.

Figure 5:
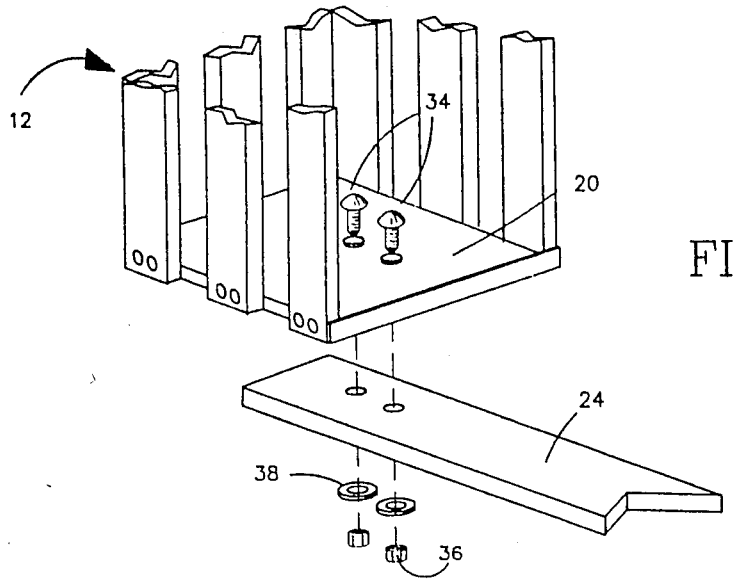
FIG. 5 is a fragmentary exploded view in perspective showing the means for fastening the collapsible barrier to the foot board.
Figure 6:
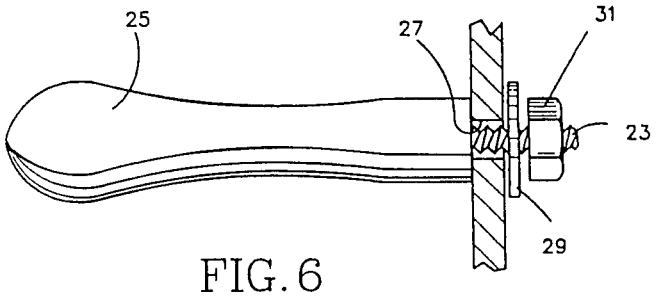
FIG. 6 is a detailed elevational view, partly in fragmentary section, showing the means for securing the steering and stabilizing handles to the collapsible barrier.

The chassis 14 comprises a foot board 24 to which skateboard wheel mounts 26, hereinafter called "trucks", and wheels 28 are mounted to the foot board's underside. A brake board 30 is pivotally secured to the rear portion of the footboard 24 by pivot rod means 32. As best shown in FIG. 5, barrier 12 is secured to footboard 24 by a pair of ½" carriage bolts 34 which pass through holes in bottom shelf 20, and footboard 24 and are secured to the underside of footboard 24 by nuts 36 and washers 38. Referring to FIG. 6, threaded studs 23 in handles 25 are fitted in holes 27 of slats 1 and 9 and are secured thereto by washers 29 and nuts 31.

Figure 3:
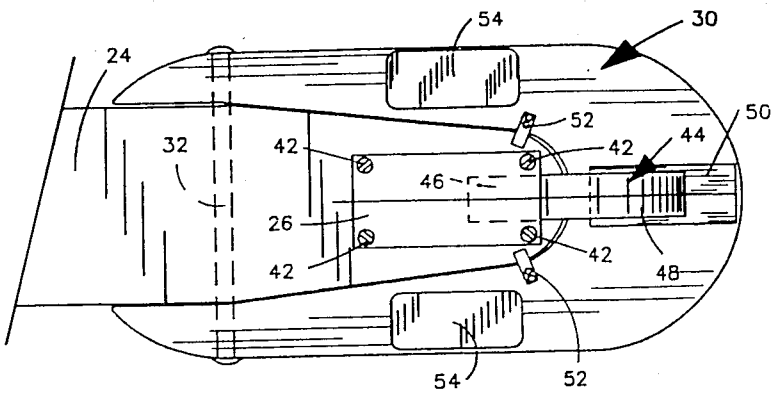
FIG. 3 is a fragmentary bottom plan view taken along the line 3—3 of FIG. 2.
Figure 4:
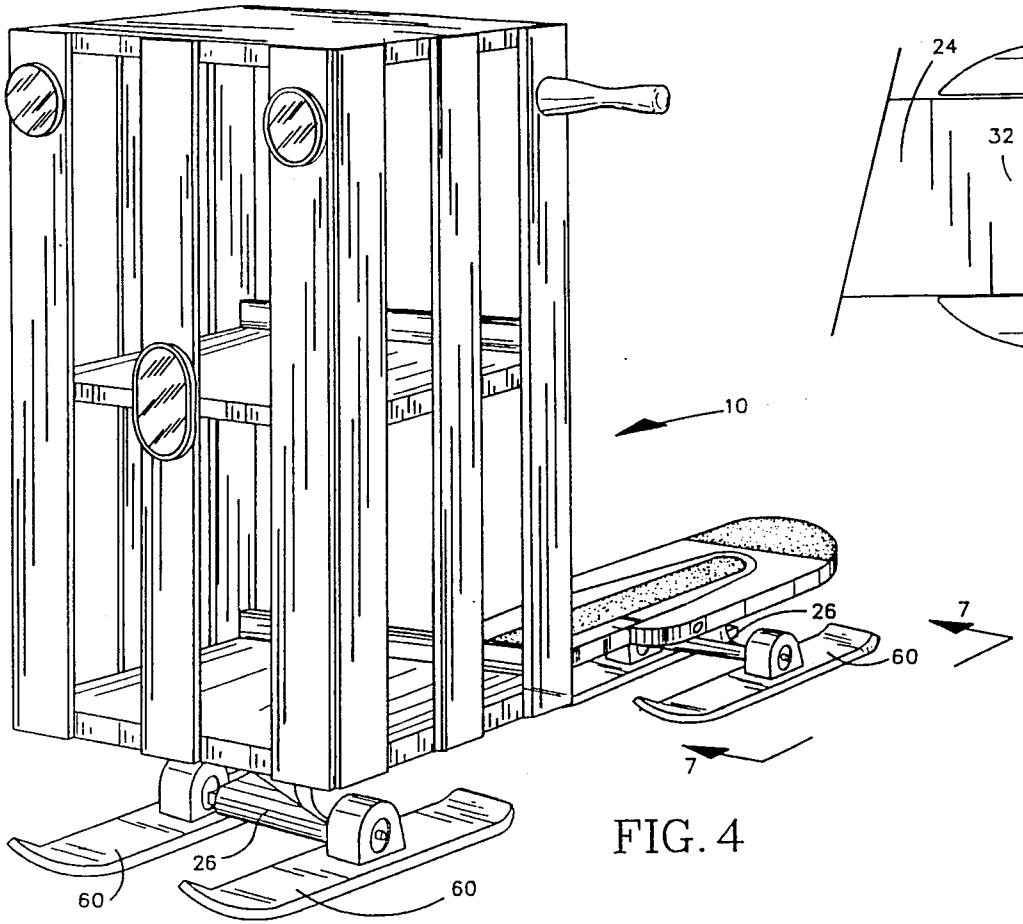
FIG. 4 is a perspective view of a preferred embodiment of the invention equipped with skids for winter use.

Referring now to FIGS. 2 and 3, therein is shown the brake means for summer use. A pair of skate wheels 28 are mounted on axle 40 which is secured in axle truck 26. Truck 26 is fastened to the underside of footboard 24 by threaded fasteners 42. Brakeboard 30 is biased upwardly about pivot rod 32 by leaf spring 44 which has an inboard end 46 secured between truck 26 and footboard 24. An outboard end 48 of leaf spring 44 is positioned to make sliding engagement with a pressure plate 50, secured to the underside of brakeboard 30 by threaded fasteners, an adhesive or any other suitable means. The upward bias of brakeboard 30 is delimited by detent plates 52, FIG. 3, secured to the underside of brakeboard 30 by threaded fasteners. Brake pads 54 are secured to the underside of brakeboard 30 and positioned to make pressure engagement with wheels 28 when the brakeboard 30 is depressed.

Figure 7:
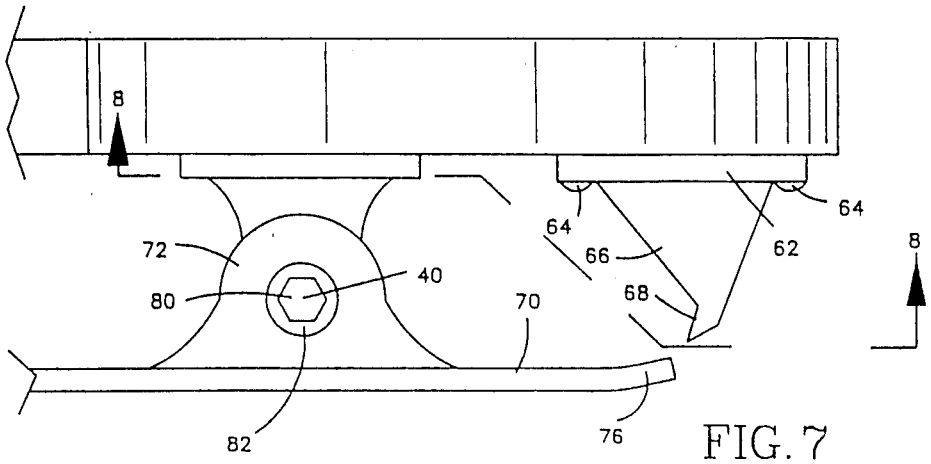
FIG. 7 is a fragmentary side elevational view taken along the line 7—7 of FIG. 4.
Figure 8:
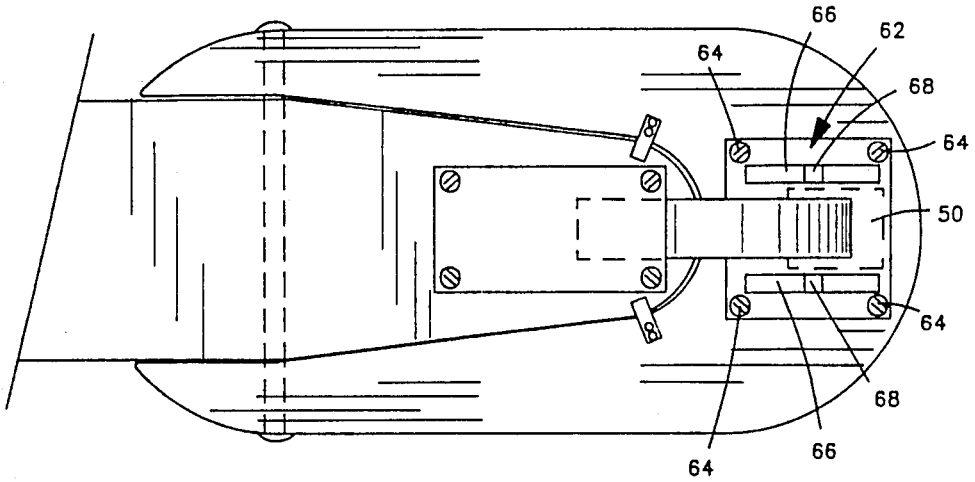
FIG. 8 is a fragmentary bottom plan view taken along the line 8—8 of FIG. 7.
Figure 9:
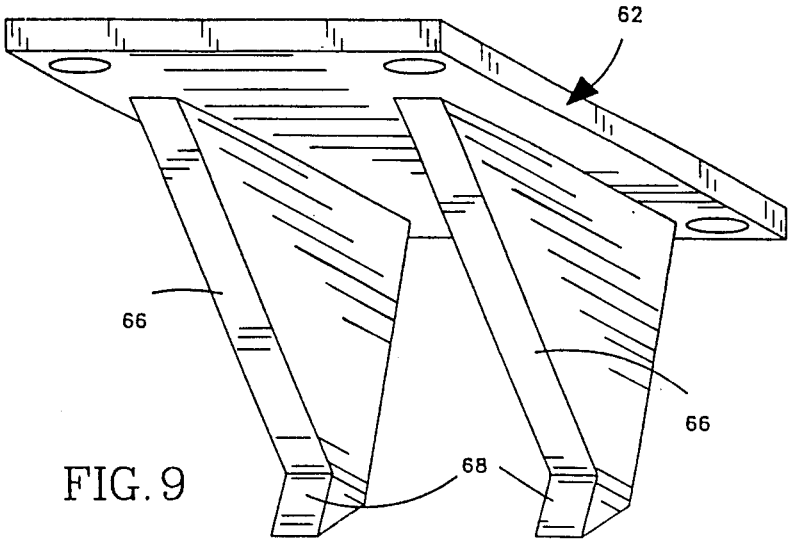
FIG. 9 is a perspective view of the claw shown in FIGS. 7 and 8.

FIGS. 4 through 9 illustrate the device 10 retrofitted with skids for winter use. As shown generally in FIG. 4, the wheels 28 have been removed from the trucks 26 and have been replaced by skids 60. Also, a claw brake 62, FIGS. 7–9, is secured over pressure plate 50 with threaded fasteners 64 on the underside of brakeboard 30. The claw brake 62 includes a pair of claws 66 having chisel edges 68 between the skids 60 adapted to dig into ice and snow to slow or arrest forward movement of the device.

Figure 10:
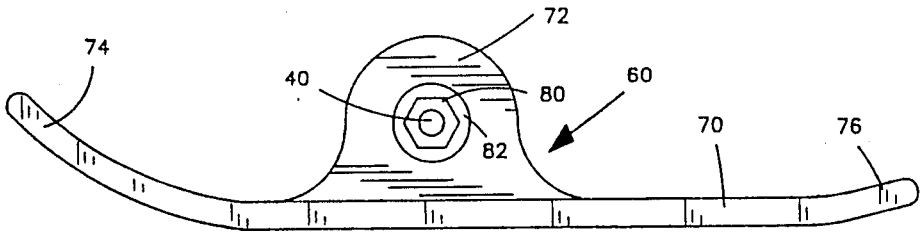
FIG. 10 is a side elevational view of a preferred embodiment of a skid for use in retrofitting the device for snow surface use.
Figure 11:
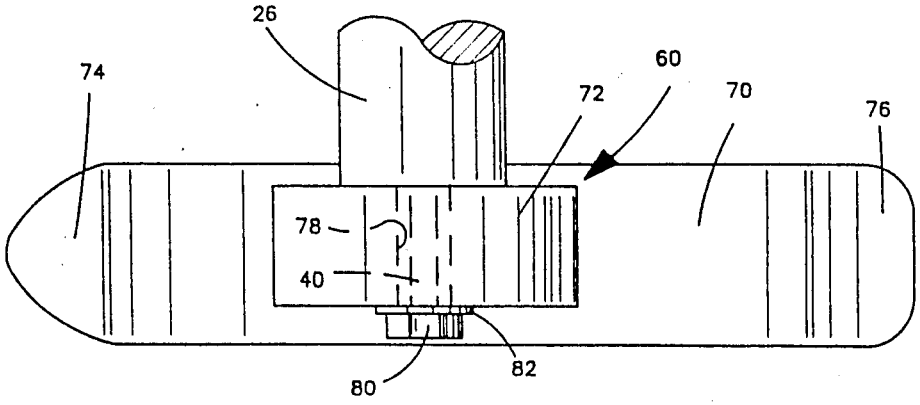
FIG. 11 is a top plan view of the skid shown in FIG. 10.

Reference is now made to the skid 60, per se, shown in FIGS. 10 and 11. This skid is preferably made of molded plastic, such as a compound of polyurethane, and comprises a runner 70 and a mounting boss 72. The head 74 of the runner 70 is curved upwardly to negotiate surface irregularities encountered when the device is in use. The tail 76 is also slightly curved upward to facilitate sideslipping of the runner 70 on the surface during turning. A transverse axle hole 78 is provided in mounting boss 72 adapted to receive the axle 40 therethrough. The same nuts 80 and washers 82 used to secure wheels 28 to truck axles 40 may be reused to secure skids 60 to these same axles 40.

Although preferred embodiments of the subject invention have been shown and described, it will be appreciated by those skilled in the art that additional embodiments, modifications and improvements can be readily anticipated by those skilled in the art based on a reading and study of the present disclosure. Such additional embodiments, modifications and improvements may be fairly presumed to be within the spirit, scope and purview of the invention as defined by the subtended claims.

What is claimed is:

1. A locomotion device comprising:

a substantially planar footboard;

a front skateboard truck assembly, including a pair of wheels, secured to the front underside of said footboard;

a rear skateboard truck assembly, including a pair of wheels, secured to the rear underside of said footboard;

a substantially planar brakeboard pivotally secured to the rear portion of said footboard said brakeboard having a U-shape with an end portion and two leg portions which are adapted to nest along the rear end portion and rear side portions respectively of said footboard;

pin means for pivotally securing the leg portions of said brakeboard to said footboard;

detent means secured to the underside of said brakeboard for limiting the upward pivotal movement of said brakeboard to a position which is coplanar with said footboard;

a leaf spring secured at one end to the rear underside of said footboard and at its other end to the underside of said brakeboard, said other end being curved arcuately upwardly for biasing said brakeboard upwardly into said coplanar position; and a brake pad secured to the underside of each leg portion of said brakeboard, each brake pad being positioned over a respective wheel of said rear skateboard truck assembly, wherein said brakeboard is adapted to be urged downwardly for bringing said brake pads into frictional engagement with said rear wheels.

2. The device of claim 1, wherein said leaf spring has a fixed end secured to the underside of the rear portion of said footboard and a free end adapted to slidingly engage the underside of said brakeboard and adapted to bias said brakeboard upwardly.

3. The device of claim 2, including pressure plate means secured to the underside of said brakeboard means to receive the free end of said leaf spring in sliding contact therewith.

4. The device of claim 1, including safety barrier means secured to the forward portion of said footboard, and hand grip means secured to said safety barrier means for use to stabilize the user of said device.

5. The device of claim 4, wherein said safety barrier comprises a collapsible impact structure including rectangular top and bottom members; upright slats laterally spaced apart and secured to said top and bottom members to form a hollow structure having four rectangular sides.

6. The device of claim 5, wherein said collapsible impact structure is comprised of wood and secured together by wood screws.

7. The device of claim 5, wherein said safety barrier top and bottom members and slats are wooden and secured together by wood screws adapted to yield under said impact beyond a predetermined force.

8. The device of claim 1, including a safety barrier secured to the forward top side of said footboard adapted to absorb impact.

* * * * *